United States Patent [19]

Myers et al.

[11] 4,299,099

[45] Nov. 10, 1981

[54] OPEN FRONT REFRIGERATION SYSTEM

[75] Inventors: James E. Myers; Tom E. Kennedy, both of Niles; Arthur Perey, Buchanan, all of Mich.

[73] Assignee: Tyler Refrigeration Corporation, Niles, Mich.

[21] Appl. No.: 6,074

[22] Filed: Jan. 24, 1979

[51] Int. Cl.[3] ..... A47F 3/04

[52] U.S. Cl. ..... 62/256

[58] Field of Search ..... 62/254, 256

[56] References Cited

U.S. PATENT DOCUMENTS

| | | | |
|---|---|---|---|
| 3,812,684 | 5/1974 | Brown | 62/256 X |
| 3,827,254 | 8/1974 | MacMaster et al. | 62/256 |
| 4,023,378 | 5/1977 | Kennedy et al. | 62/256 |
| 4,077,228 | 3/1978 | Schumacher et al. | 62/256 |
| 4,117,697 | 10/1978 | Myers et al. | 62/256 |
| 4,117,698 | 10/1978 | Vogel | 62/256 |
| 4,144,720 | 3/1979 | Subera et al. | 62/282 |
| 4,145,893 | 3/1979 | Vogel | 62/255 X |

*Primary Examiner*—Daniel M. Yasich

*Attorney, Agent, or Firm*—LeBlanc, Nolan, Shur & Nies

[57] ABSTRACT

A refrigeration system having an open front display portion and a rear storage portion. The display portion has a plurality of shelves that are accessible through an opening in the front of the display portion. Access to the shelves also can be obtained from the rear storage portion of the system. A cooling unit is provided that includes a fan and two sets of refrigerating coils. The cooling unit provides refrigerated air from one set of coils to an air conduit for establishing a primary air curtain across the front of the display portion. The refrigerated air from the other set of coils is supplied to an air conduit which in turn supplies the air to the storage portion. A second air curtain is also provided across the front of the display portion; this secondary air curtain extends along a path positioned towards the outside of the display portion with respect to the primary air curtain. A return path for the air from the primary and secondary air curtain is provided along the bottom of the display portion.

4 Claims, 4 Drawing Figures

OPEN FRONT REFRIGERATION SYSTEM

BACKGROUND OF THE INVENTION

The present invention relates to refrigerated or frozen food display cases, and particularly of the roll-in type. As used herein, the terms refrigerated food and cases include both frozen food and cases (maintained at temperatures below 32° F.) and food and cases maintained above 32° F., such as dairy cases.

The present invention is particularly suited for supermarket or other commercial installations in which the display case is open at the front to permit continuous and easy consumer access to refrigerated food products contained in the display area.

Previous walk-in type refrigeration systems generally have been designed for special purposes, one system at a time. In designing such systems, numerous compromises had to be made between the display arrangements and duct work in the system. This, of course, necessitated that a different type of refrigerator be designed and built each time a different type of display was desired, thereby significantly increasing the cost of each system. Furthermore, since each system was designed separately this also affected the reliability of the system.

Various types of open front refrigerated display cases are known. Some examples described in the patent literature include: Henderson, U.S. Pat. No. 2,450,088; Swanson, U.S. Pat. No. 2,923,137; Kennedy, U.S. Pat. No. 2,961,845; Barroero, U.S. Pat. No. 2,962,875; Rainwater, U.S. Pat. No. 2,984,085; Detwiler, U.S. Pat. No. 2,993,349; Jacobs, U.S. Pat. No. 3,021,691; Mathis, U.S. Pat. No. 3,044,274; Fanick, U.S. Pat. No. 3,063,225; Richman, U.S. Pat. No. 3,123,988; Wile, U.S. Pat. No. 3,139,737; Jarvis, U.S. Pat. No. 3,139,738; Brennan, U.S. Pat. No. 3,499,295; and Rainwater, U.S. Pat. No. 3,690,118. Two open front refrigerated display cases of particular interest that are assigned to the same assignee as the present application are: Myers et al., U.S. Pat. No. 4,117,697, and Kennedy et al., U.S. Pat. No. 4,023,378.

SUMMARY OF THE INVENTION

An object of the present invention is to provide a standardized design in which the refrigeration equipment is relatively independent of the desired display configuration.

Another object of the present invention is to provide a walk-in or roll-in rear loading refrigeration system having an open front display section and a rear storage section, which system is capable of utilizing a variety of display configurations.

A further object of the present invention is to provide a unitized refrigeration circuit which is usable for a variety of shelf and/or cart display configurations.

Still another object of the present invention is to provide a bifurcated primary refrigeration air circuit capable of simultaneously cooling the storage section and display section.

Still a further object of the present invention is to provide a bifurcated primary refrigeration circuit in combination with a secondary unrefrigerated, but colder than ambient temperature, air circuit, so that the two circuits provide primary and secondary air curtains across the open front of the display case.

Still a further object of the present invention is to provide a walk-in type refrigeration system having a bifurcated primary refrigeration system and mechanism for establishing a secondary air curtain such as set forth above and a return air passageway for receiving the air from the primary and secondary air curtain and passing such air into the storage section.

Still a further object of the present invention is to package the refrigeration system in such a manner that:

(1) it is capable of being unitized;
(2) the coiling for the storage section and display section are packageable in the same unit;
(3) one fan system supplies air for both coil sections;
(4) no insulation is required for the coil assembly;
(5) the system consists essentially of a walk-in cooler with an opening, having the coil assembly installed in the front upper section; and
(6) shelving independent of the coil system but compatible with it is available as a separate option. The shelving may be suspended from the ceiling so that the posts are left short of the floor, thereby permitting the rolling-in of displays beneath the posts which also serve as pilasters for a bracket system to hold the shelves, on which food may be displayed.

Still a further object of the present invention is to provide a third ambient air curtain across the open front of the display section which further inhibits infiltration of moisture into the display area and which is dissipated into the aisle in front of the display case.

The above objectives are achieved by providing a refrigeration system in accordance with the present invention. The refrigeration system includes a front display case having an open front for allowing access to a plurality of shelves arranged within such case and a rear storage case that is arranged behind the display case and allows for access to the shelves arranged within the display case. A cooling unit is arranged along the top of the refrigeration system and serves to provide refrigerated air both to the display case and the rear storage case. The cooling unit includes a first mechanism for refrigerating air to be directed the storage case and a second mechanism for refrigerating air to be directed the display case along with a fan for supplying air to both of the refrigerating mechanisms. A first air conduit that is associated with the first air refrigerating mechanism carries refrigerated air from such refrigerating mechanism to the storage case. A second air conduit receives the air passing through the second refrigerating mechanism and directs such air along a path extending substantially vertically along the open front of the display case so as to establish a primary air curtain. Another mechanism provides air which is unrefrigerated but cooler than ambient air along a path extending substantially vertically across the opening in the display case but positioned toward the outside of the display case with respect to the primary air curtain. A return air conduit is arranged along the bottom of the display case for receiving the air from the primary and secondary air curtains and contains a return air fan for propelling such air along the air conduit and into the storage case.

As will become apparent from the detailed description presented further below, numerous embodiments of the present invention are possible within the scope of the present invention. The four specific embodiments described herein are only illustrative of the present invention.

The secondary air curtain can be formed from air obtained from one of two sources. In a first embodiment of the present invention, the air for the secondary air curtain is obtained by diverting a portion of the air passing through the fan that supplies air to the two sets of refrigerating mechanism and directing such diverted air along the path for forming the secondary air curtain. An alternative approach is to provide a separate conduit extending from the storage case to the front of the display case and to provide a separate fan within such air conduit for propelling air along the conduit. This air that is drawn from the storage portion is propelled along the front of the display case in a path for forming the secondary air curtain.

Within the scope of the present invention, it also is possible to provide a third air curtain that extends vertically along the front of the display case but outside of the display case. The third air curtain is generally known as an ambient air curtain. For this purpose, a third air conduit is provided at the top front portion of the display case, and positioned within such conduit is a further fan for drawing in ambient air from the surroundings of the refrigeration system and directing such air along a path for forming the ambient air curtain.

In the four exemplary embodiments of the present invention that are described herein, each of the refrigerating mechanisms are formed by two sets of evaporation coils. Each set of coils is finned. Preferably, in the first set of coils closest to the fan, the fins are more widely spaced apart than in the second set. Such an arrangement provides a more efficient frost collection system. The first set of coils will collect a greater amount of frost as the air is initially cooled; the employment of the widely spaced fins in these coils allows for better airflow during frost buildup. Although the closely spaced fins of the second set of coils are more prone to frost buildup, they collect less frost since the air passing over them is substantially dried out after having passed over the first set of coils.

The two refrigerating mechanisms in each system can be either vertically or horizontally arranged. In a vertically arranged system, the first and second sets of coils of one of the mechanisms are arranged over the first and second sets of coils of the other mechanism. Both mechanisms are located above the display section of the system along with the fan which is immediately upstream of the mechanisms. In the horizontally arranged system, both mechanisms along with the fan are horizontally arranged within a conduit. The fan is positioned between the two mechanisms so as to propel air into the conduit and force such air towards the coils of each mechanism. The entire unit is located at the top of the system and extends over the display section and part of the storage section. With the horizontal arrangement, less space is consumed in the display section thereby leaving more space for the refrigerated products.

DESCRIPTION OF THE PREFERRED EMBODIMENTS

Figure 1:
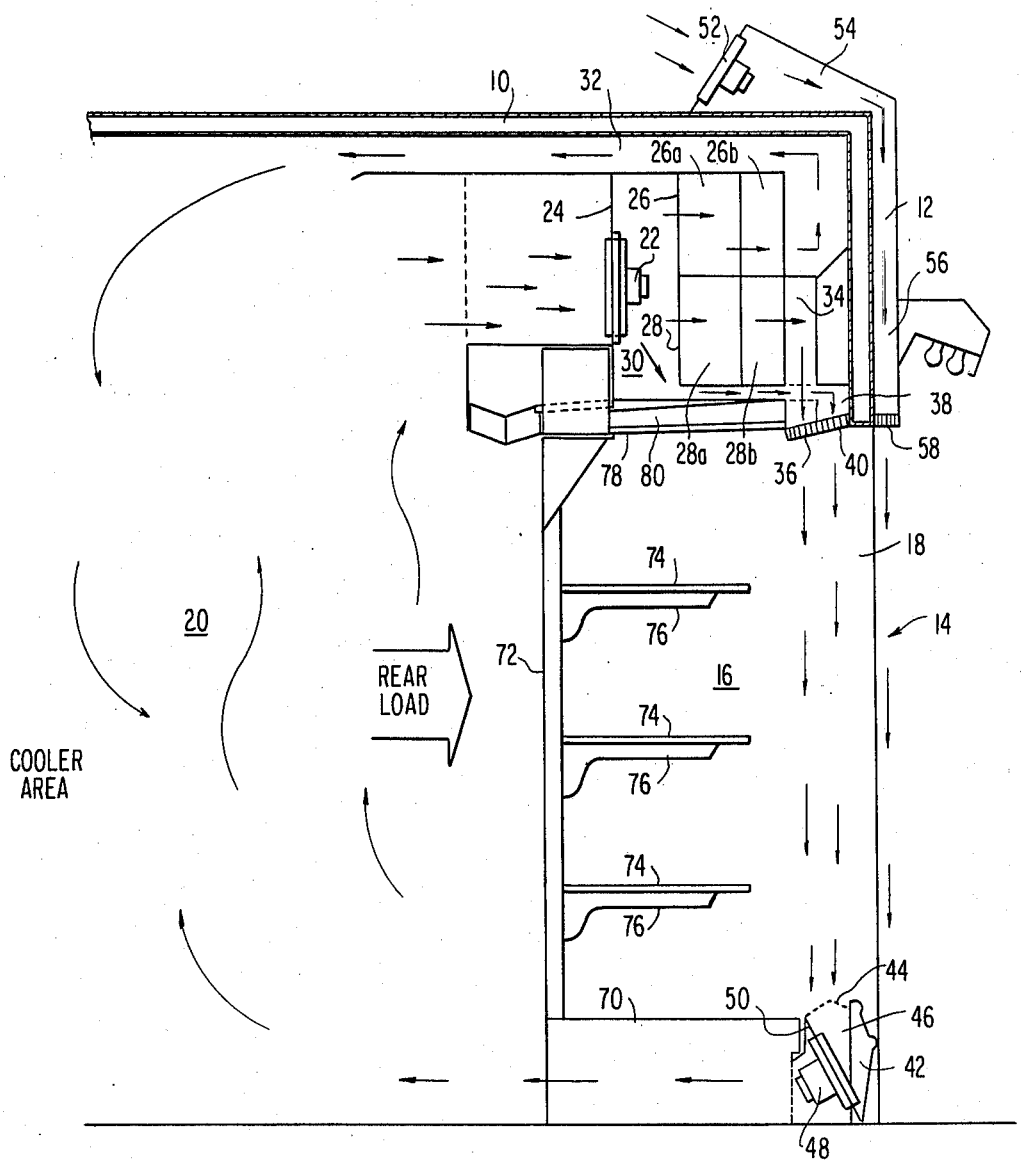
FIG. 1 is a side schematic view of a first embodiment of the present invention.

FIG. 1 shows a first embodiment of the unitized open front refrigerator of this invention. The refrigerator cabinet includes an insulated upper front face panel 12 extending downwardly from the front end of top 10 along the front of the display case to define the upper boundary of an access opening 14 into a display section 16. The cabinet also includes side walls 18 (one of which is shown in FIG. 1), a storage or cooler area 20 is located in the refrigerator cabinet behind the display section 16.

The refrigeration equipment, including the fan, evaporator coils and duct work to be described in more detail below are located in the upper front portion of the cabinet above the display section 16. In particular, one or more air circulating fans 22 are mounted in conventional manner on a baffle plate 24 which extends along the length of the inside of the cabinet. Two sets of evaporating coils 26, 28 are mounted one above the other in a plenum chamber 30 downstream of fans 22. Evaporator coils 26 and 28 each may advantageously comprise two sets (e.g. 24 tubes) of refrigeration coils **26*a*, 26*b* and 28*a*, 28*b*, through which air is forced by the action of fans 22**.

Each set of coils is finned; preferably, the fins of coils sets **26*a* and 28*a* are more widely spaced apart than those of their associated respective coil sets 26*b* and 28*b*. This arrangement provides an efficient frost collection system. The upstream sets of coils 26*a*, 28*a* will collect the greater amount of frost as the air is initially cooled; the use of widely spaced fins allows better air flow during frost buildup. The closely spaced finned coils 26*b*, 28*b*, although more prone to frost buildup than the wider spaced fins, collect less frost because the air passing over them is substantially dried out from passing over the upstream sets of coils 26*a*, 28*a***, respectively.

At their downstream end, evaporator coils 26 open into a first refrigerated air duct 32 which opens at its open downstream end directly into storage area 20. Evaporator coils 28 open at their downstream end into a second refrigerated air duct 34 which terminates at its downstream end in directional louvers 36. A further airflow path through plenum 30 extends around the exterior of the evaporator coils and into a further conduit 38 which lies outwardly of conduit 34 and terminates in directional louvers 40 to direct air downwardly across the open front of display section 16. Thus an inner, refrigerated air band is formed by air exiting from conduit 34 downwardly across the open front of the display section 16 and an outer band of air that is unrefrigerated but has a temperature lower than the ambient air is created by air flowing out of conduit 38 downwardly across the open front of the display section.

At the bottom of the display section is a front kickpanel 42. The height of panel 42 is determined by the function of the refrigerated cabinet, i.e. what types of food are to be stored and displayed. Normally, the kickpanel of a meat case will be relatively high, to permit stacking of meats in the case, a deli-cabinet will have a lower kickplate and a dairy products case will have the lowest bottom front panel.

A grill work 44 extends from the top of the lower base panel 42 partially into display section 16. Grill 44 covers a plenum chamber 46 housing a plurality of return fans 48 which are mounted in a baffle plate 50 in a similar fashion to the mounting of fans 22. Fans 48 create a negative pressure to draw air from the first and second air bands into and through the return plenum 46; this return airflow is directed along the bottom of the display section back to and into the storage section 20.

Advantageously, means also may be provided to form a third air curtain across the front of the open display section 16, which third air curtain is located exteriorly of the second air curtain. This third air curtain is created by means of one or more fans 52 mounted in a housing 54 located on the outside of the refrigerated cabinet. Housing 54 opens into a duct 56 downstream of fans 52 which terminates in directional louvers 58. Air is drawn into the housing 54 by means of fans 52 and is forced out through duct 56, exiting therefrom downwardly across the open front of the display section 16. This third ambient air band dissipates back into the store in front of the display case as its lower end.

The presence of the third air curtain serves to inhibit infiltration of warmer room air into the open display section 16. Further, the third air band serves to prevent the first and second air band, consisting of refrigerated air and unrefrigerated but colder than ambient air, respectively, from being infiltrated by the warmer room air. Such infiltration would ordinarily increase the temperature of the refrigerated air, thereby reducing its cooling capability and at the same time would impart moisture to the refrigerated air (from the moisture laden ambient air) which would result in a more rapid accumulation of condensate in the form of snow, ice or frost on the evaporator coils or in the storage area 20, through which air is returned to the refrigeration system to complete the closed circuit.

In operation, fans 22 draw air out of storage area 20 which air is then forced by these fans through plenum 30. One portion of the air is driven through evaporator coils 26 and into conduit 32. The air flowing through conduit 32, which is refrigerated, is returned by the conduit 32 directly to storage area 20 contains this portion of the cabinet in a low temperature state.

A second portion of the air in plenum 30 is forced through evaporator coils 28 and into conduit 34. This air, which is also refrigerated, is forced out through directional louvers 36 to form an inner, refrigerated air curtain flowing downwardly across the open front of display space 16. A third portion of air in plenum 30 flows around the outside of the evaporator coils into conduit 38 from which it flows outwardly and downwardly across the open front of the display space 16 in the form of an intermediate or secondary air curtain. The primary and secondary air curtains are drawn into return plenum 46 by fans 48, where the air is mixed and returned along the bottom of the cabinet into the storage area 20. This return air rises in storage area 20 by convection and the negative pressure created by fans 22 to mix with the air flowing out of conduit 32. Thus, it will be seen that a closed circuit is provided for maintaining a constant flow of refrigerated and/or cooled air across the front of the display section and into the storage area 20.

Figure 2:
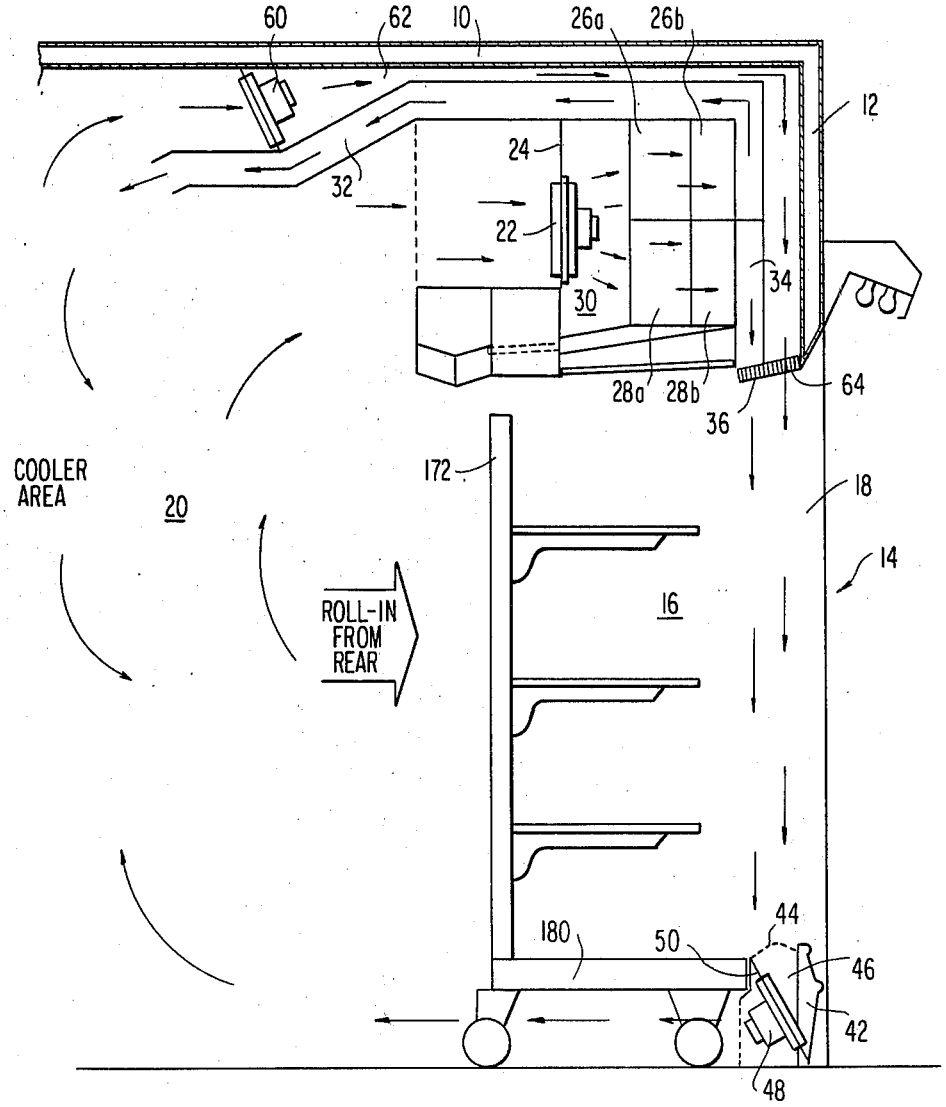
FIG. 2 is a side schematic view of a second embodiment of the present invention.

FIG. 2 shows a second embodiment of the unitized refrigeration system of this invention. In FIGS. 1 and 2, like reference numerals designate similar parts. In this embodiment, all of the air drawn into plenum 30 by fans 22 is forced through one or the other of evaporator coils 26 and 28. A third set of fans 60 is located at the upstream end of a conduit 62 which terminates in directional louvers 64 adjacent the downstream end of conduit 34 and directional louvers 36. Fans 60 draw air from storage area 20 into conduit 62, from which it flows outwardly and downwardly across the open front of display section 16 to form the secondary air curtain lying outwardly of the primary refrigerated air curtain emanating from the outlet of conduit 34. It will be seen that the source of air for the secondary air curtain is the storage area 20. The temperature of this air, while not as cold as the air issuing directly out of refrigerated air conduits 32 or 34, is still substantially colder than the ambient air outside the case. Thus the operation and function of the system shown in FIG. 2 is essentially the same as that of the embodiment of FIG. 1.

Figure 3:
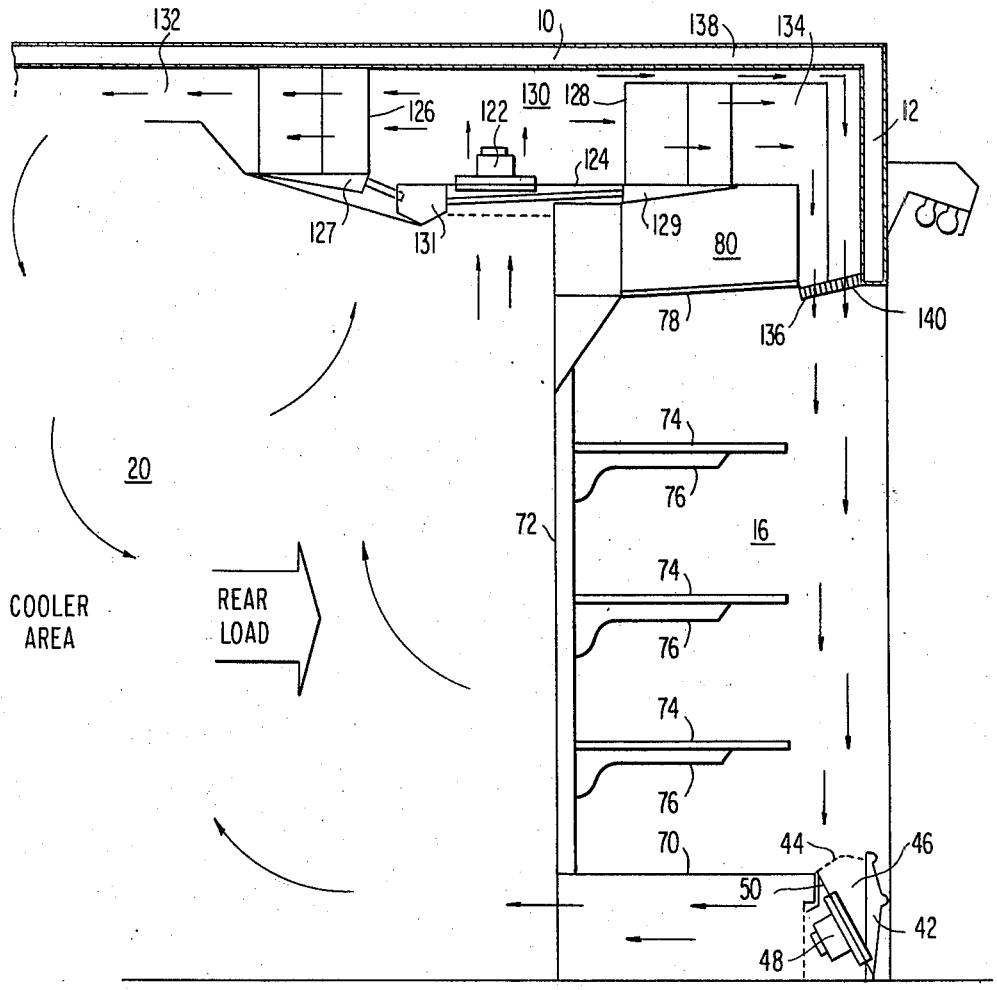
FIG. 3 is a side schematic view of a third embodiment of the present invention.

FIG. 3 shows still another embodiment of the unitized refrigerator construction of this invention. This design may be advantageous where height restrictions are placed on the dimensions of the refrigerated cabinet. Again, like reference numerals designate the same elements shown in FIGS. 1 and/or 2.

In the embodiment of FIG. 3, one or more primary air circulating fans 122 are mounted in a baffle 124 to draw air into a plenum 130 in an upward direction from storage area 20. A first set of evaporator coils 126 is located at one side of plenum 130 and a second set of evaporator coils 128 is located at the other side of plenum 130 in substantially the same horizontal plane as coils 126. At their downstream end, coils 126 may open directly into storage area 20 or into a relatively short conduit 132 which in turn is open at its downstream end to the interior of storage area 20.

Coils 128 open at their downstream end into a conduit 134 which terminates at its downstream end in directional louvers 136. A space is provided around coils 128 to define a further conduit 138 which runs adjacent conduit 134 and terminates at its downstream end in directional louvers 140 adjacent directional louvers 136.

Drip pans 127 and 129 are provided beneath evaporator coils 126 and 128, respectively. The drip pans feed, through conduits in any known manner, into a condensate collector 131, which may be conveniently located at the bottom of plenum 130. In the defrost cycle, frost which has accumulated on the evaporator fins condenses and runs off into the drip pans and condensate collector. From there, it flows by gravity force into a drain as is conventional.

In operation, air from the storage section 20 is drawn by fans 122 into plenum 130. The positive pressure in plenum 130 forces one portion of the air therein through coils 126 and duct 132 back into storage section 20. This refrigerated air stream thus acts to cool the storage section.

A second portion of air in plenum 130 is forced through evaporator coils 128 into conduit 134. From there it flows downwardly across the open front of display section 16 in the form of a primary or refrigerated air curtain. A third portion of air in plenum 130 flows around the outside of coils 128 through conduit 138, from which it flows outwardly of the primary air curtain and downwardly in the form of a secondary air curtain across the open front of display section 16. The temperature of this secondary air curtain is higher than the temperature of the primary refrigerated air curtain but substantially lower than the temperature of the ambient air in the store.

At their downstream ends, the primary and secondary air curtains are drawn into return plenum 46 by return fans 48, which then force the return air along the bottom of the refrigerated cabinet back into storage section 20.

Fans 122 create a negative pressure in storage section 20 to draw this return air as well as the refrigerated air emanating from conduit 132 back into plenum 130. It will therefore be seen that this creates a closed airflow circuit within the refrigerated cabinet to maintain both the display and storage sections at the desired cold temperature.

It should be noted that each of evaporator coils 126 and 128 may be constructed in two parts in the same manner as coils 26 and 28, respectively, described with respect to the embodiments of FIGS. 1 and 2.

Figure 4:
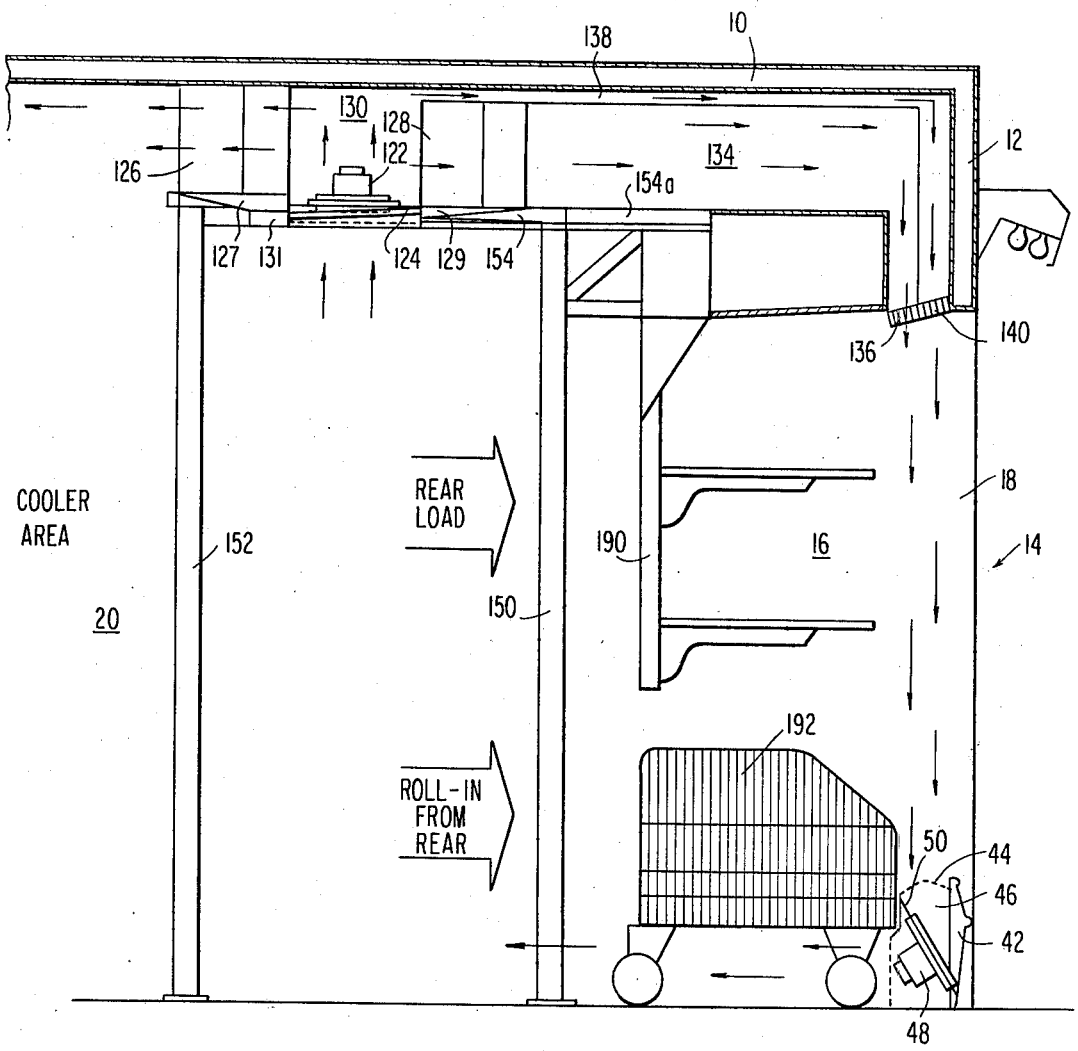
FIG. 4 is a side schematic view of a fourth embodiment of the present invention.

FIG. 4 shows a modified form of the embodiment of FIG. 3. Again, like reference numerals designate similar elements as are shown in FIGS. 1, 2 and/or 3. In this embodiment, the refrigeration assembly comprising fans 122 and evaporator coil sets 126, 128 are supported on a framework comprising front and rear upstanding posts 150, 152 and horizontal top members 154. This construction permits the refrigeration equipment to be mounted and braced substantially independently of the refrigerated cabinet itself and thus avoid having to strengthen the cabinet, and particularly the top portion thereof, to support the weight of the refrigeration equipment. Other advantages of the construction shown in FIG. 4 will become apparent below. In all other essential respects, the embodiment of FIG. 4 operates in the same way as the embodiment of FIG. 3.

It will be seen that the present invention, comprising a unitized construction for a refrigeration system, is substantially wholly independent of the shelving or other display arrangement which it may be desired to use. Thus, FIGS. 1 and 3 show a display section arrangement which comprises a base portion 70 and a plurality of vertical supports 72 upstanding from the rear portion of base 70. One or more shelves 74 may be hung from upright members 72 which are slotted to accommodate shelf brackets 76 in a conventional manner.

A display section ceiling panel 78 may be provided along the top of the display section 16 to provide the display area with a finished appearance and to seal off dead spaces, e.g. space 80 between the top of the usable display space area and the bottom of the refrigeration equipment.

Base members 70 are open from front to rear to act as a return duct for air propelled by fans 48 along the return into the storage area 20.

In the embodiment of FIG. 2, the upright members 172 are mounted on the face 180 of a rolling cart. The entire cart can be rolled back into storage area 20 to stock the shelves and then rolled back into the display area. Thus, all merchandise handling by store employees can be done from inside the refrigerated cabinet without obstructing the store aisles and without having to take refrigerated goods out of the refrigerator at any time. When the cart is disposed in the display section, as shown in FIG. 2, the cart base 180 will be high enough to provide an unobstructed path for the return airflow propelled by fans 48 along the bottom of the cabinet into storage section 20. Thus, the cart base acts as a duct or guide to direct substantially all of the airflow into the storage section.

It will be readily apparent that the product display arrangements described above can be used in any of the embodiments of this invention as described herein. FIG. 4 shows a display arrangement particularly applicable to that embodiment but which is readily adaptable to any of the embodiments shown in FIGS. 1-3.

In FIG. 4, shelf support uprights 190 hang from an extension 154*a* of horizontal support 154. Uprights 190 are high enough to allow a rolling cart 192 to be rolled thereunder into the display section 16. Also preferably, the bottom of the rolling cart is high enough to maintain a free path and to act as a guide to direct the return airflow substantially fully into the cooler or storage section 20.

From the above, it will be seen that this invention provides an apparatus whereby that portion of the refrigeration equipment (e.g. fans, duct work, evaporator coils, etc.) may be unitized so as to be substantially independent of the product display arrangement. One of the advantageous features of this invention is that the display section can be configured in any number of ways to most effectively display food products without altering the air circuits in any way. This obviously permits a standardization of the basic refrigeration components not heretofore possible from a practical standpoint.

While specific embodiments of the unitized roll-in refrigeration equipment have been shown and described in detail above, it will be understood that these embodiments may be modified without departing from the spirit of the inventive principles or scope of the inventive concepts as set forth in the hereafter appended claims.

What is claimed is:

1. A refrigeration system adapted to be loaded from the rear comprising:

a display case having an open front for allowing access thereto and being capable of having a plurality of shelves arranged therein;

a rear storage case arranged behind said display case and allowing for access to the shelves arranged within said display case;

cooling means arranged along the top of said refrigeration system and including first means for refrigerating said storage case, second means for refrigerating said display case, and first air circulating means for drawing air from said storage case and supplying such air to both said first and second refrigerating means;

said first refrigerating means including a first set of refrigerating coils and said second refrigerating means including a second set of refrigerating coils and said first and second sets of refrigerating coils being arranged adjacent to each other and extending in a vertical direction and said first air circulating means is arranged in juxtaposition with said first and second sets of refrigerating coils;

first air passage means arranged for receiving air passing through said first refrigerating means and carrying refrigerated air therefrom to said storage case;

means for establishing a primary air curtain, said primary air curtain extending substantially vertically across the opening in said display case;

second air passage means arranged for receiving air passing through said second refrigerating means and carrying refrigerated air therefrom to said means for establishing said primary air curtain;

means for establishing a secondary air curtain, said secondary air curtain extending substantially vertically across the opening in said display case along a path positioned towards the outside of said display case with respect to said primary air curtain, said means for establishing said secondary air curtain includes a third air circulating means for drawing air from said storage case and directing such air along a path for forming said secondary air curtain;

third air passage means arranged along the bottom of said display case for receiving air from said primary and secondary air curtains; and second air circulating means for propelling air received from said primary and secondary curtains along said third air passage means into said storage case.

2. A refrigeration system according to claim 1 wherein said first air circulating means serves to draw air from said storage area and to force at least a portion of such air through said first and second refrigerating means; and said means for establishing said secondary air curtain includes means for diverting a portion of the air propelled by said first air circulating means prior to such air passing through one of said first and second refrigerating means and directing such air in a substantially vertical direction along the opening in said display case.

3. A refrigeration system according to claim 1 or 2 further comprising a third air circulating means for drawing in air from the ambient atmosphere surrounding said refrigeration system and a fourth air passage means for directing such ambient air in a substantially vertical direction along the front of said display case in a location outside of said secondary air curtain.

4. A refrigeration system adapted to be loaded from the rear comprising:

a display case having an open front for allowing access thereto and being capable of having a plurality of shelves arranged therein;

a rear storage case arranged behind said display case and allowing for access to the shelves arranged within said display case;

cooling means arranged along the top of said refrigeration system and including first means for refrigerating said storage case, second means for refrigerating said display case, and first air circulating means for drawing air from said storage case and supplying such air to both said first and second refrigerating means;

said first refrigerating means including a first set of refrigerating coils and said second refrigerating means including a second set of refrigerating coils and said first and second sets of refrigerating coils being arranged adjacent to each other and extending in a vertical direction and said first air circulating means is arranged in juxtaposition with said first and second sets of refrigerating coils;

first air passage means arranged for receiving air passing through said first refrigerating means and carrying refrigerated air therefrom to said storage case;

means for establishing a primary air curtain, said primary air curtain extending substantially vertically across the opening in said display case;

second air passage means arranged for receiving air passing through said second refrigerating means and carrying refrigerated air therefrom to said means for establishing said primary air curtain;

means for establishing a secondary air curtain, said secondary air curtain extending substantially vertically across the opening in said display case along a path positioned towards the outside of said display case with respect to said primary air curtain, said means for establishing said secondary air curtain including a fourth air passage means for diverting a portion of the air passing through said first air circulating means and directing such air so that it passes into said display case along a path forming said secondary air curtain;

third air passage means arranged along the bottom of said display case for receiving air from said primary and secondary air curtains; and second air circulating means for propelling air received from said primary and secondary curtains along said third air passage means into said storage case.

* * * * *